US012644298B1

(12) United States Patent
Wang

(10) Patent No.: US 12,644,298 B1
(45) Date of Patent: Jun. 2, 2026

(54) SWIMMING POOL COVER

(71) Applicant: Yuan Wang, Dongguan (CN)

(72) Inventor: Yuan Wang, Dongguan (CN)

( * ) Notice: Subject to any disclaimer, the term of this patent is extended or adjusted under 35 U.S.C. 154(b) by 0 days.

(21) Appl. No.: 19/065,091

(22) Filed: Feb. 27, 2025

(30) Foreign Application Priority Data

Feb. 24, 2025 (CN) ..... 202520301139.3

(51) Int. Cl.
*E04H 4/10* (2006.01)

(52) U.S. Cl.
CPC ..... *E04H 4/10* (2013.01)

(58) Field of Classification Search
CPC ..... E04H 4/10; E04H 4/108; B65D 45/32
USPC ..... 4/496, 498, 503, 506
See application file for complete search history.

(56) References Cited

U.S. PATENT DOCUMENTS 3,287,740 A * 11/1966 Langer ..... E04H 4/10 4/503
3,293,665 A * 12/1966 Langer ..... E04H 4/10 292/256.65
3,354,472 A * 11/1967 Steinbeck ..... E04H 4/10 4/503
3,355,745 A * 12/1967 Jannuzzi ..... E04H 4/106 211/180
3,391,410 A * 7/1968 Melberg ..... E04H 4/10 292/256.65
5,826,283 A * 10/1998 Edwards ..... E04H 4/10 4/503
6,286,157 B1 * 9/2001 Baumann ..... E04H 4/103 4/503
6,408,453 B1 * 6/2002 Song ..... E04H 4/103 4/499
12,241,272 B1 * 3/2025 Li ..... E04H 4/108
2008/0155749 A1 * 7/2008 Stevens ..... A47G 9/0246 5/496
2010/0058529 A1 * 3/2010 Decker ..... E04H 4/103 4/499
2017/0035210 A1 * 2/2017 Nekhala ..... A47G 9/0246
2019/0298079 A1 * 10/2019 Renwei ..... B32B 37/20

* cited by examiner

*Primary Examiner* — David P Angwin
*Assistant Examiner* — William R Klotz

(57) ABSTRACT

A swimming pool cover includes a flexible cover layer, a hanging lug, and a first tightening rope body. The flexible cover layer includes a middle part and a peripheral part. The peripheral part is connected to the middle part. The middle part is used for covering a swimming pool opening of a swimming pool. The peripheral part is used for surrounding an outer side wall of the swimming pool. The peripheral part is provided with a first outer edge. The hanging lug is connected to the covering layer. The hanging lug is positioned on the peripheral part. A spacing is defined between the hanging lug and the first outer edge. The hanging lug is provided with a first rope threading opening. The first tightening rope body is threaded through the first rope threading opening. A spacing is defined between the first tightening rope body and the first outer edge.

20 Claims, 13 Drawing Sheets

SWIMMING POOL COVER

CROSS-REFERENCE TO RELATED APPLICATIONS

The application claims priority of Chinese patent application CN2025203011393, filed on Feb. 24, 2025, which is incorporated herein by reference in its entireties.

TECHNICAL FIELD

The present invention relates to the field of swimming pool protective covers, particularly to a swimming pool cover.

BACKGROUND ART

With the improvement of people's living standards, family swimming pools have become increasingly popular during the hot summer months. However, the maintenance of outdoor independent swimming pools is a challenge, as exposed pools are prone to accumulating dust, fallen leaves, insects, and other debris that can contaminate the pool water, thereby increasing the frequency and cost of cleaning and maintenance. Currently, swimming pool covers on the market are typically made of lightweight materials. In practical use, due to the light fabric of the swimming pool covers, the swimming pool covers will be easily blown up or even blown away during windy weather, resulting in the swimming pool being exposed and affecting the use effect.

Therefore, there is an urgent need on the market for a swimming pool cover that is less likely to detach from the swimming pool and has better protective performance, so as to provide users with a better experience.

SUMMARY

In order to overcome the shortcomings of the prior art, a swimming pool cover is provided in the present invention. The swimming pool cover includes:

- a flexible cover layer, wherein the flexible cover layer includes a middle part and a peripheral part, the peripheral part is connected to the middle part, the middle part is used for covering a swimming pool opening of a swimming pool, the peripheral part is used for surrounding an outer side wall of the swimming pool, and the peripheral part is provided with a first outer edge;
- a hanging lug, wherein the hanging lug is connected to the covering layer, the hanging lug is positioned on the peripheral part, a spacing is defined between the hanging lug and the first outer edge, and the hanging lug is provided with a first rope threading opening; and
- a first tightening rope body, wherein the first tightening rope body is threaded through the first rope threading opening, a spacing is defined between the first tightening rope body and the first outer edge, and the first tightening rope body is used for tightening the peripheral part onto the outer side wall of the swimming pool.

Beneficial effects of the present invention are as follows. The swimming pool cover is provided in the present invention. The swimming pool cover includes the flexible cover layer, the hanging lug, and the first tightening rope body. The flexible cover layer includes the middle part and the peripheral part. The peripheral part is connected to the middle part. The middle part is used for covering the swimming pool opening of the swimming pool. The peripheral part is used for surrounding the outer side wall of the swimming pool.

The peripheral part is provided with the first outer edge. The hanging lug is connected to the covering layer. The hanging lug is positioned on the peripheral part, and a spacing is defined between the hanging lug and the first outer edge. The hanging lug is provided with the first rope threading opening. The first tightening rope body is threaded through the first rope threading opening, and a spacing is defined between the first tightening rope body and the first outer edge. The first tightening rope body is used for tightening the peripheral part onto the outer side wall of the swimming pool. The flexible cover layer can completely cover the swimming pool opening, which can effectively prevent dust, fallen leaves, insects, and other debris from entering the swimming pool, thereby maintaining the cleanliness of the pool water, reducing cleaning frequency and maintenance costs. Moreover, the peripheral part of the flexible cover layer is used for surrounding the outer side wall of the swimming pool, and the stability of the swimming pool cover is increased by a frictional force between the peripheral part and the outer side wall of the swimming pool, preventing the swimming pool cover from being displaced. Furthermore, the hanging lug is provided with the first rope threading opening, the first tightening rope body is threaded through the first rope threading opening, and the first tightening rope body is used for tightening the peripheral part onto the outer side wall of the swimming pool, so that the wind resistance of the swimming pool cover is further enhanced, and the swimming pool cover is not easy to be blown up or displaced even in strong wind weather. Furthermore, due to the spacing between the hanging lug and the first outer edge, and the spacing between the first tightening rope body and the first outer edge, the first outer edge and the first tightening rope body jointly surround and tighten the outer side wall of the swimming pool, further enhancing the wind resistance of the swimming pool cover, and making the swimming pool cover not easy to be blown up or displaced even in strong wind weather. Moreover, even when the first tightening rope body is displaced to be detached from the outer side wall of the swimming pool, the first outer edge can still surround the outer side wall of the swimming pool, preventing the peripheral part from detaching from the outer side wall of the swimming pool.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
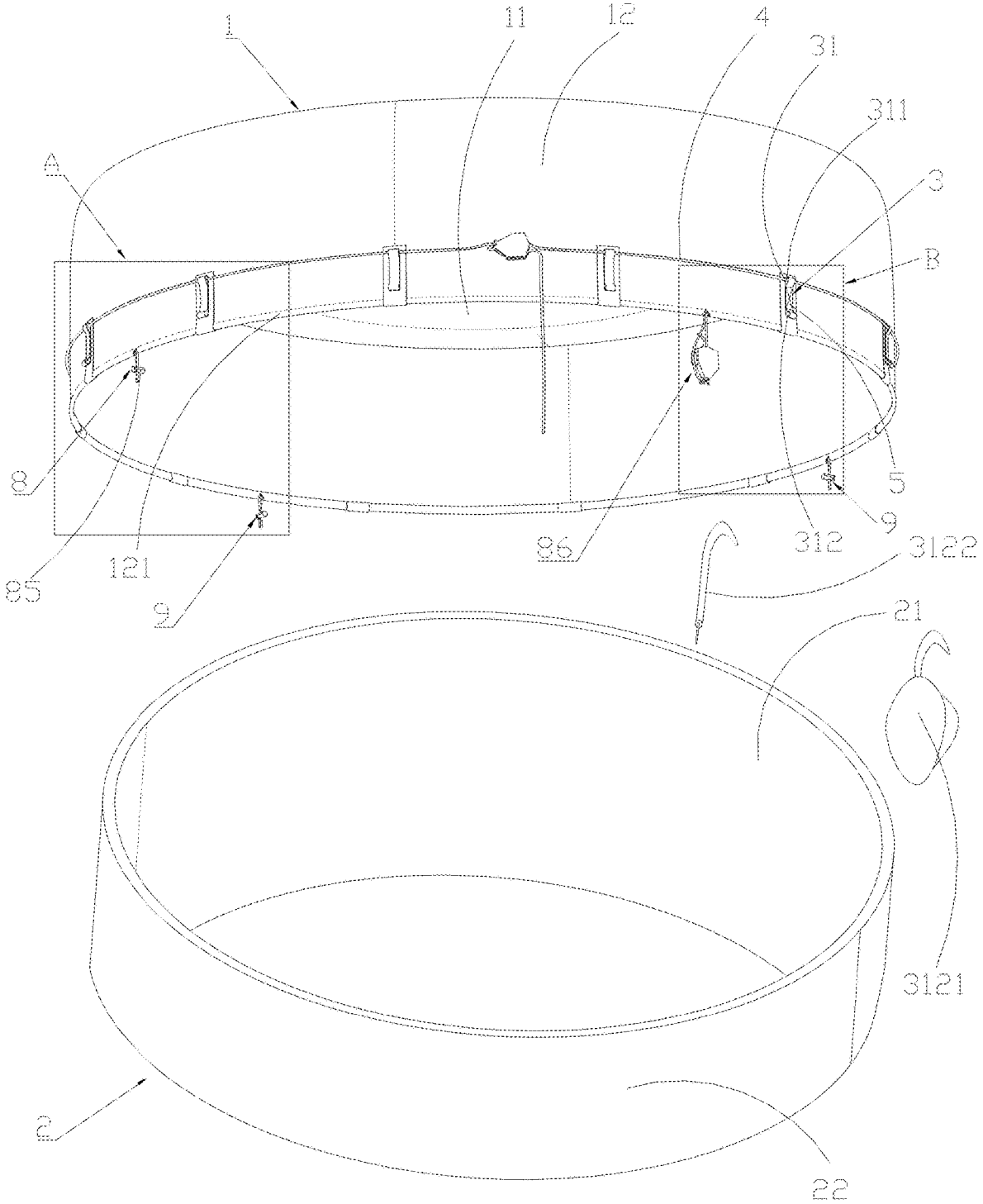
FIG. 1 is a schematic diagram of an overall structure of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
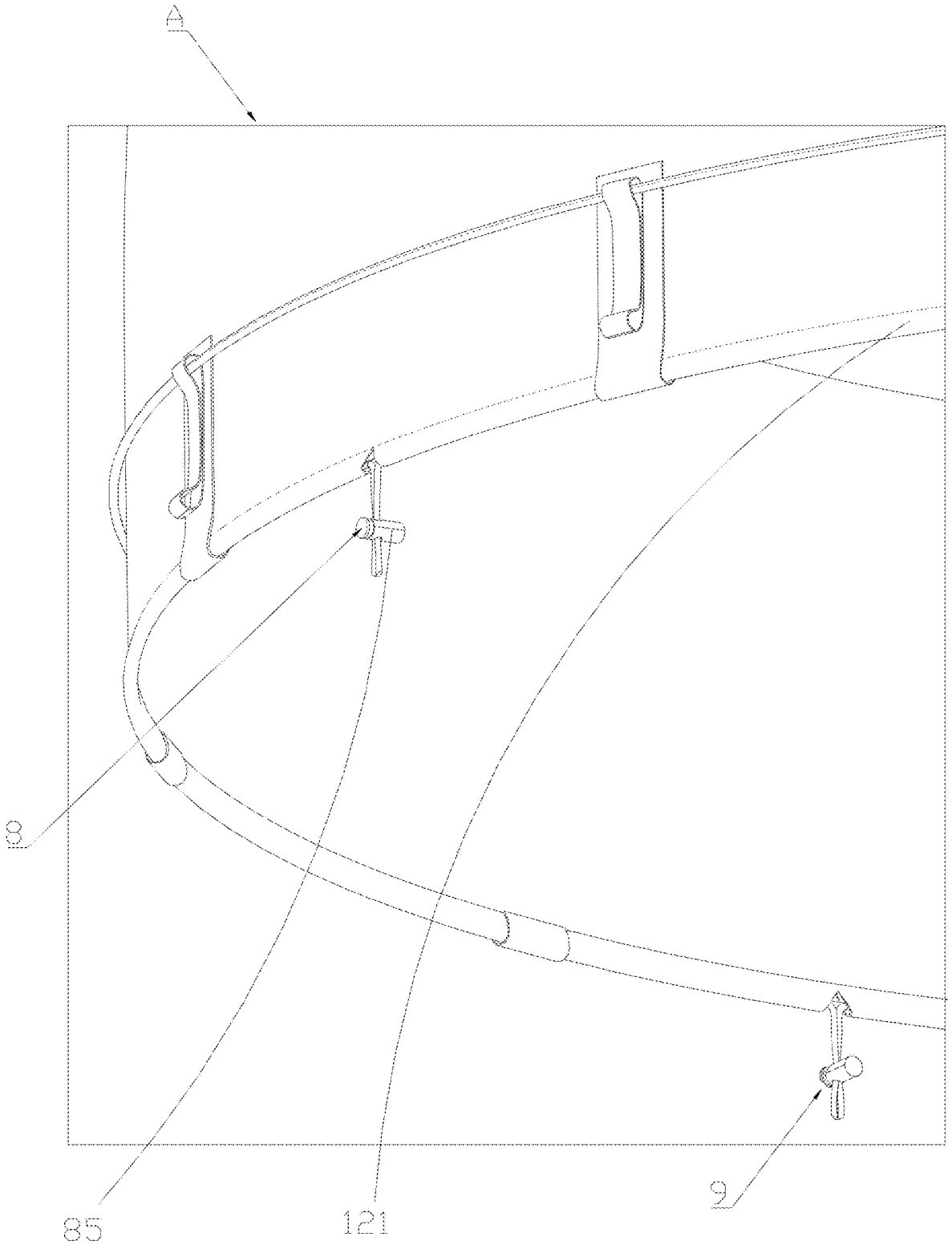
FIG. 2 is an enlarged view of area A in FIG. 1.
Figure 3:
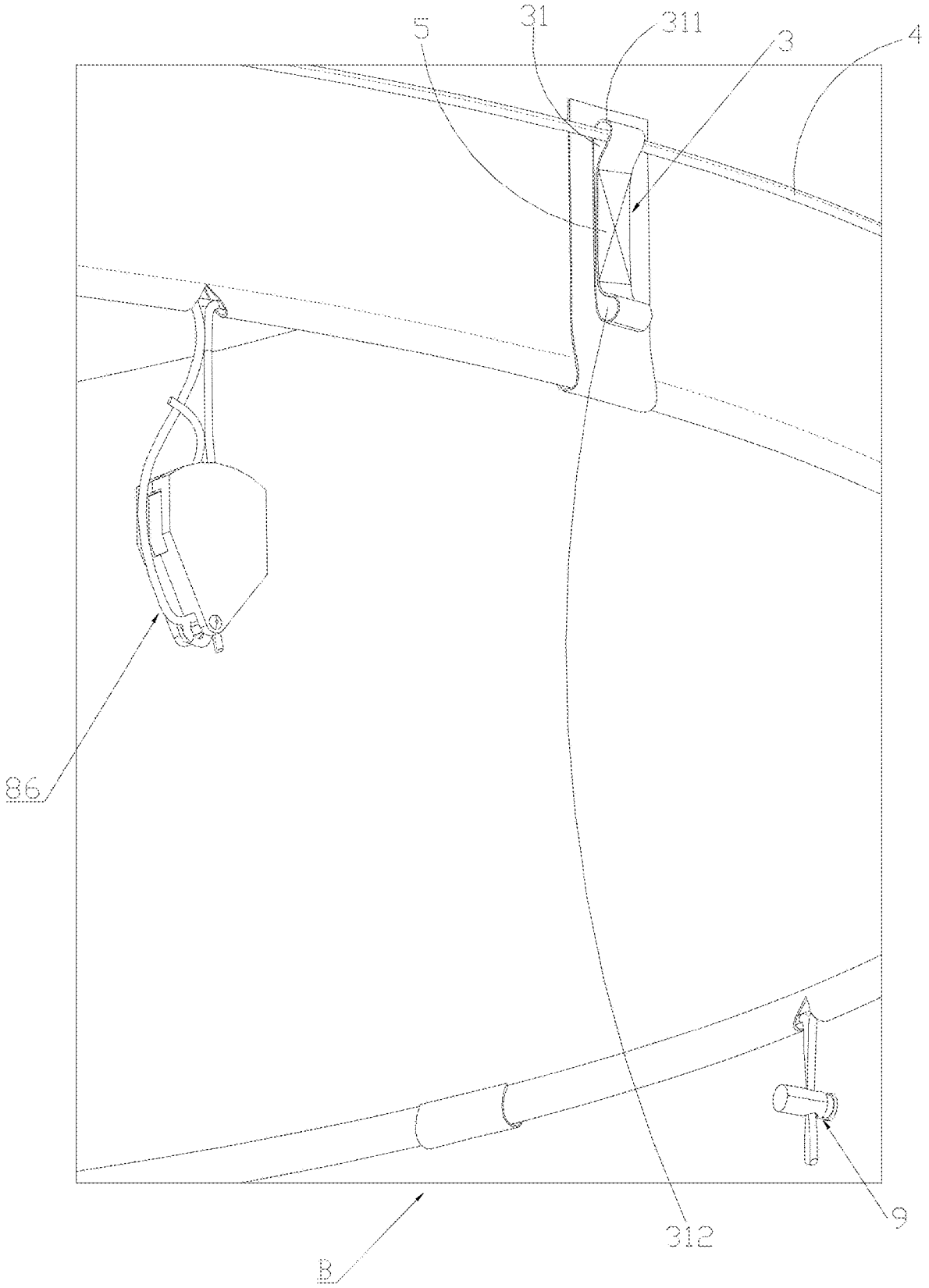
FIG. 3 is an enlarged view of area B in FIG. 1.
Figure 4:
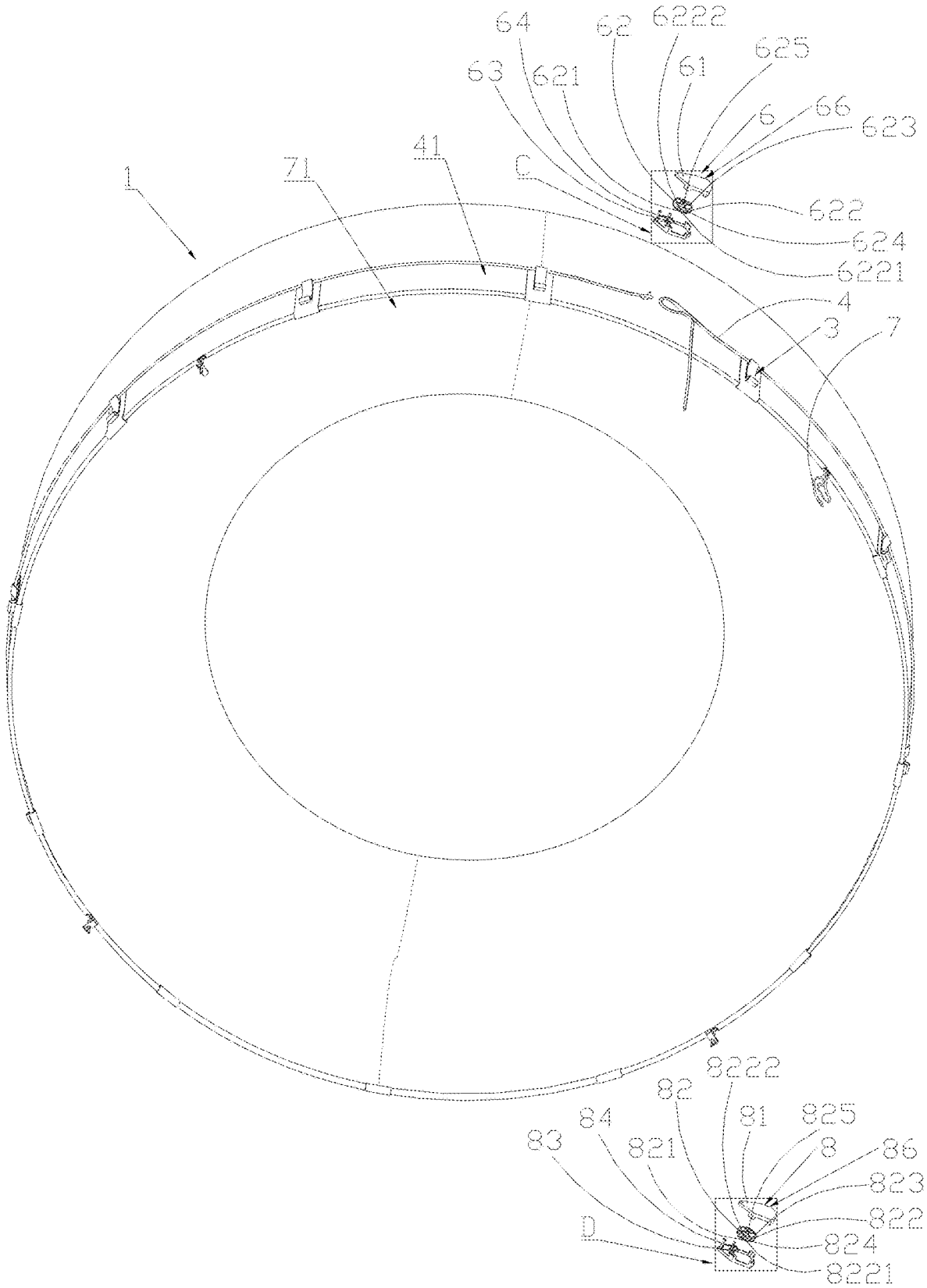
FIG. 4 is another schematic diagram of an overall structure of the present invention.
Figure 5:
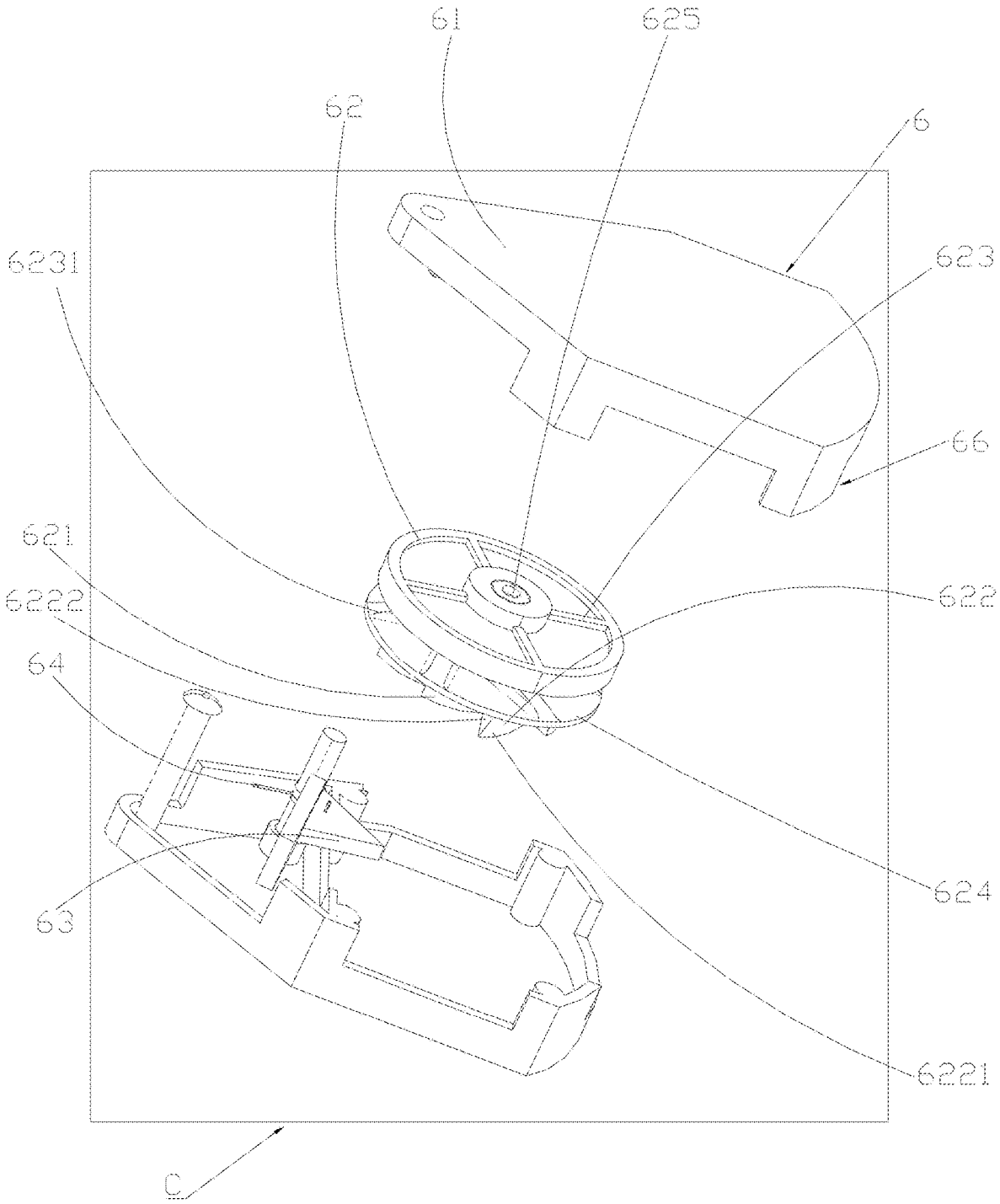
FIG. 5 is an enlarged view of area C in FIG. 4.
Figure 6:
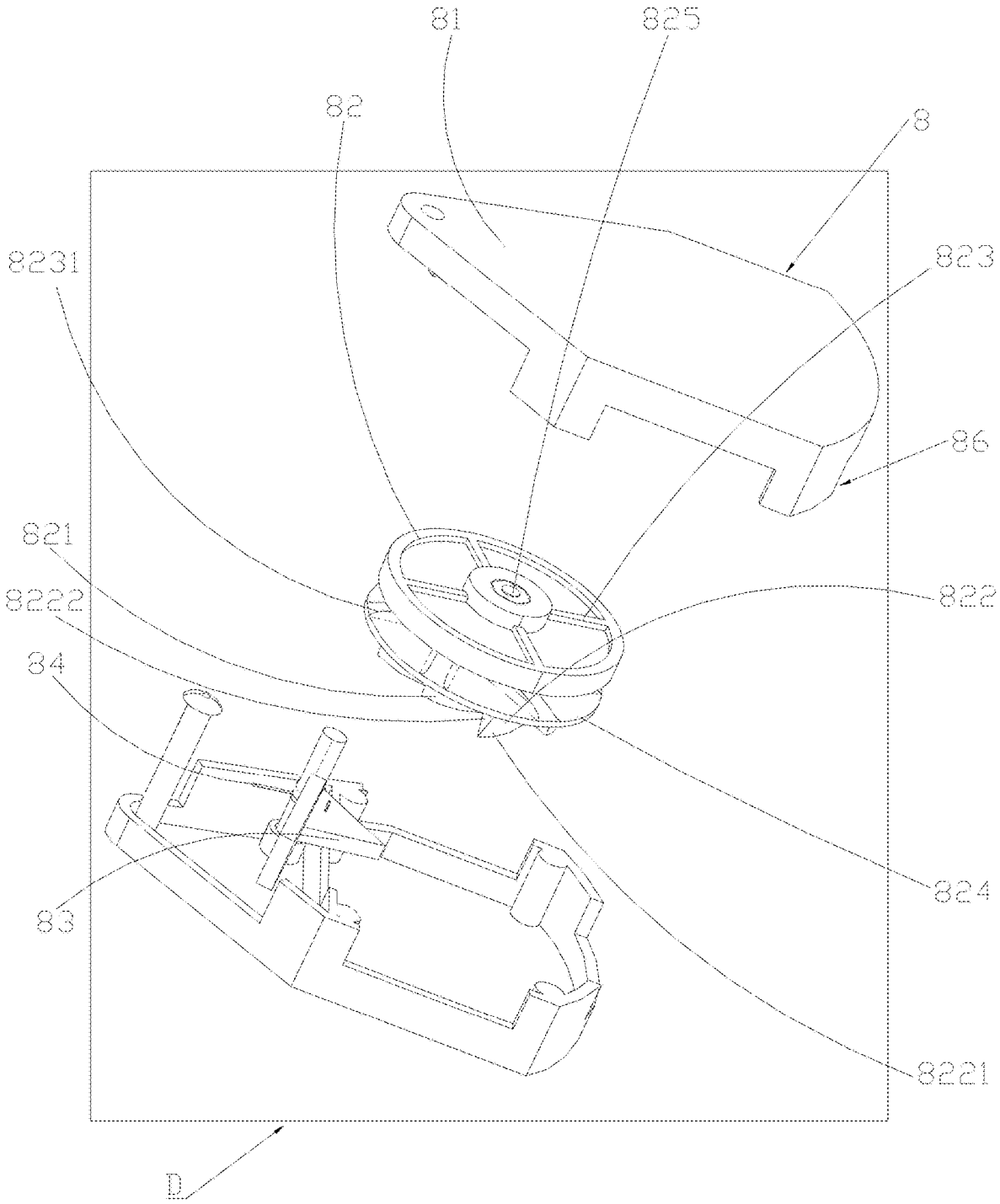
FIG. 6 is an enlarged view of area D in FIG. 4.
Figure 7:
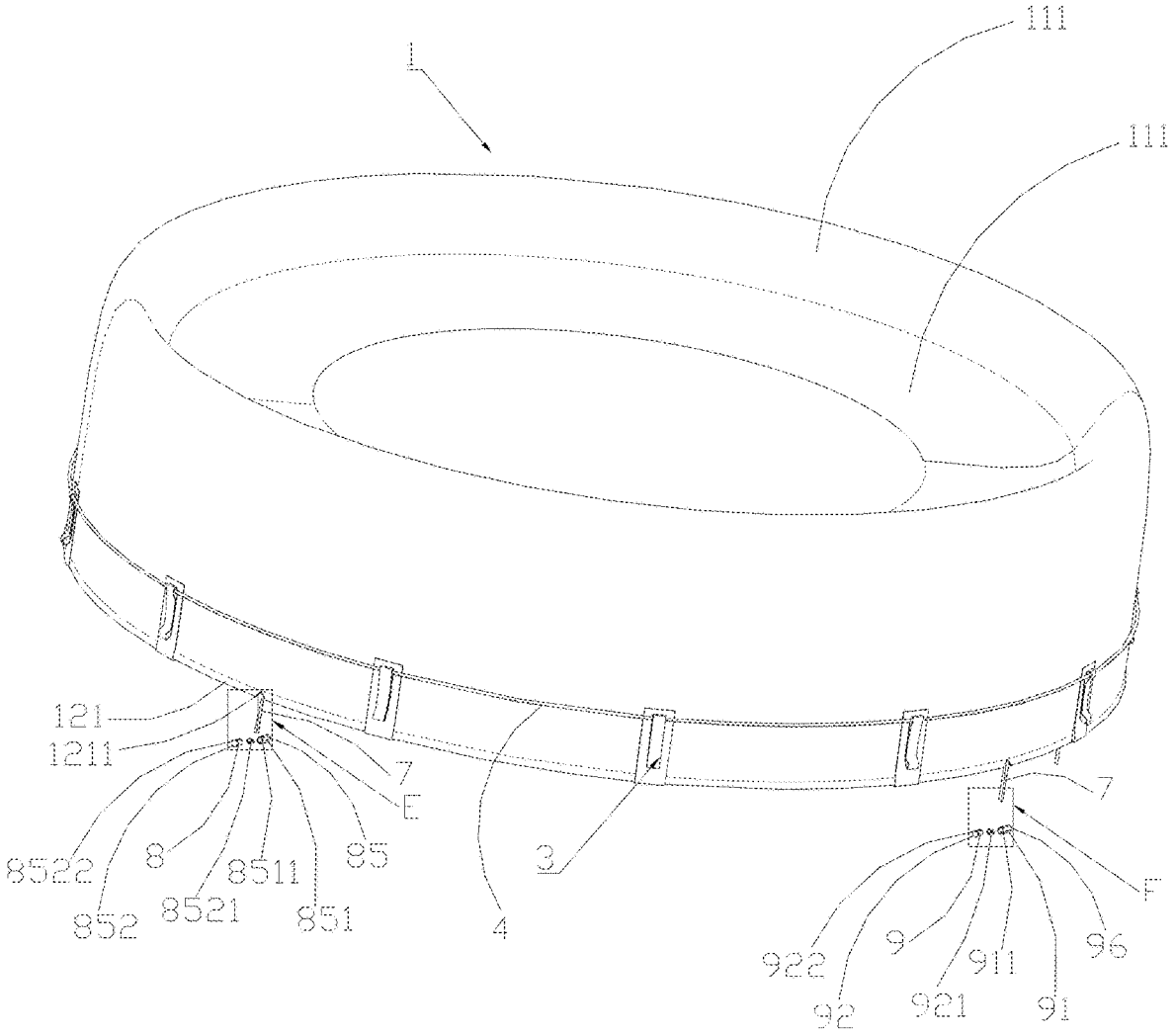
FIG. 7 is another schematic diagram of an overall structure of the present invention.
Figure 8:
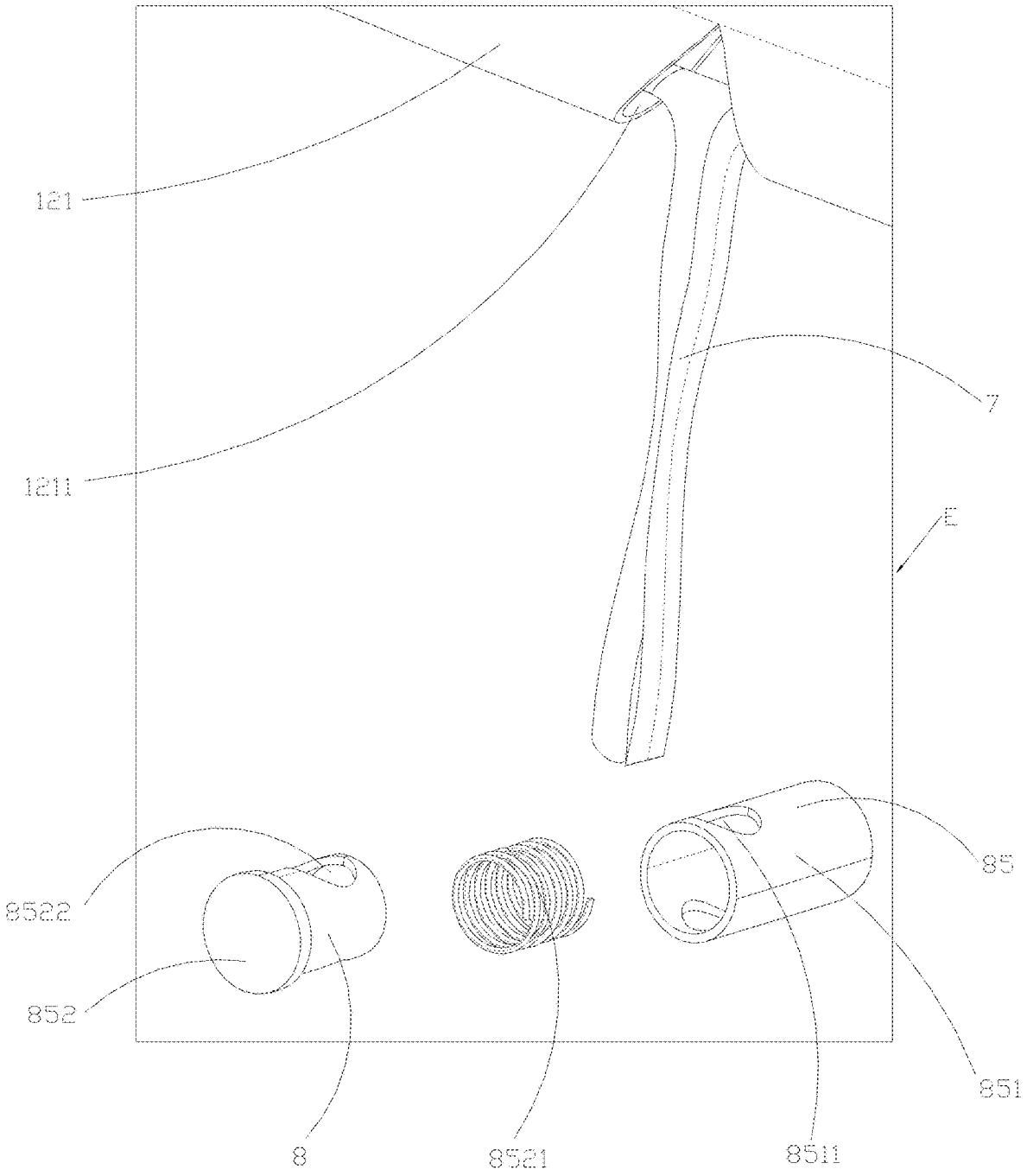
FIG. 8 is an enlarged view of area E in FIG. 7.
Figure 9:
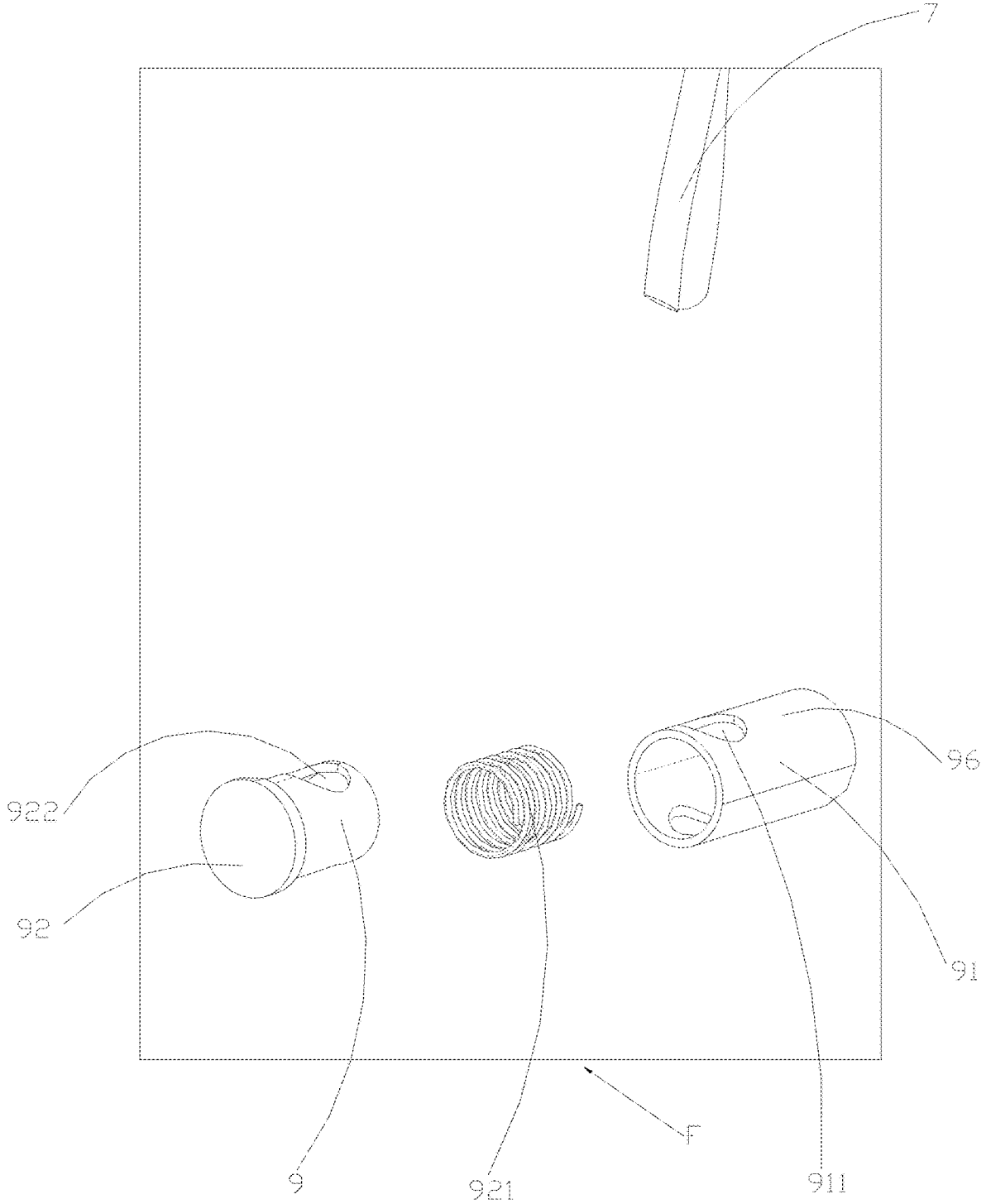
FIG. 9 is an enlarged view of area F in FIG. 7.
Figure 10:
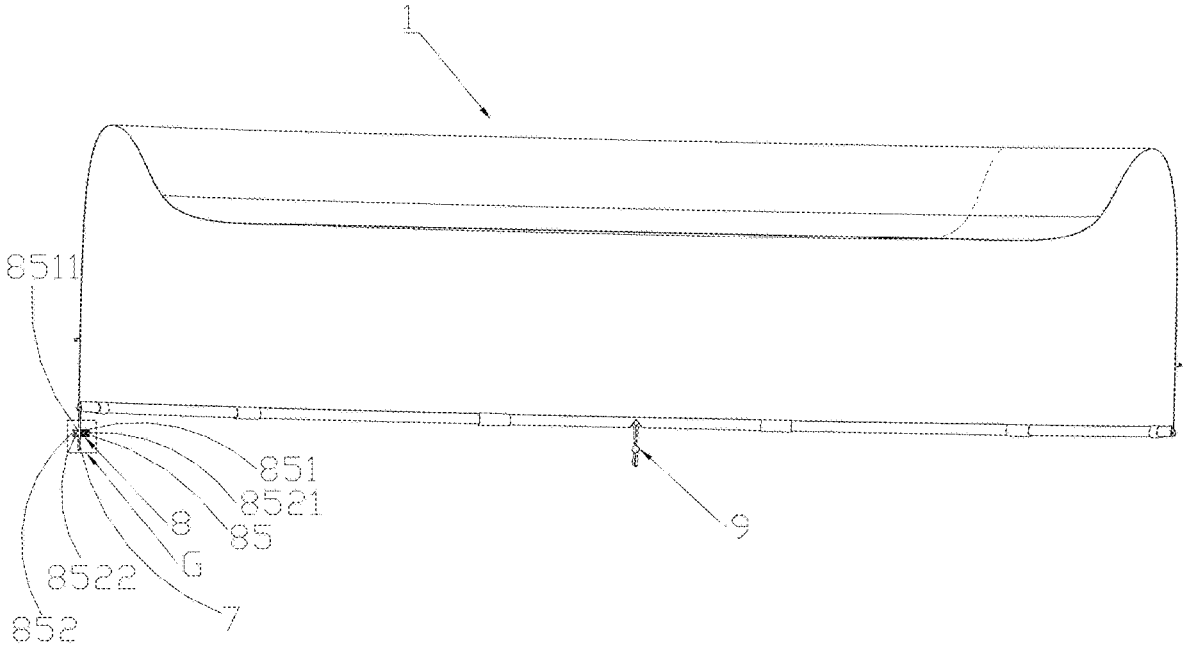
FIG. 10 is a sectional view taken along a second elastic adjusting buckle.
Figure 11:
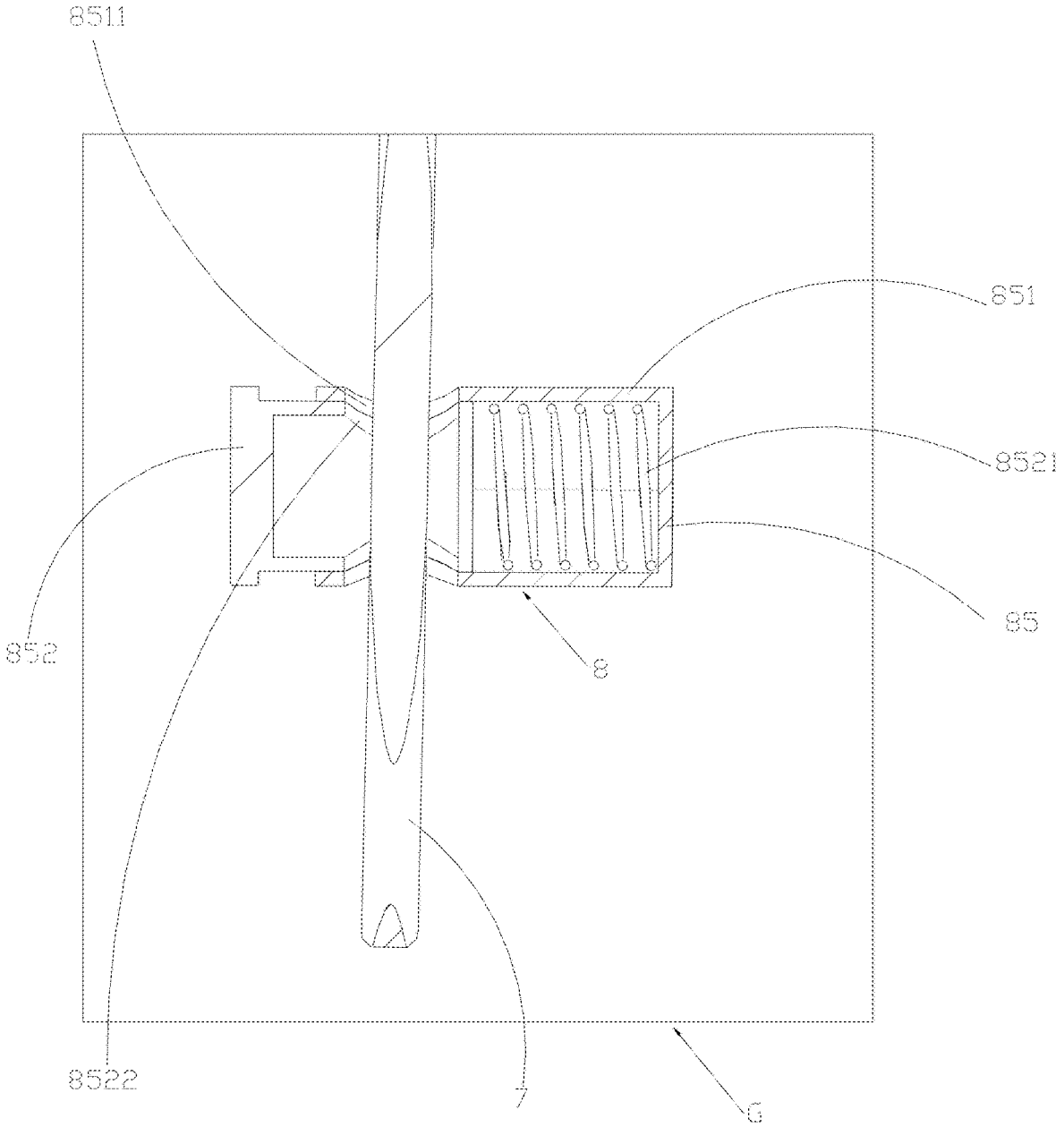
FIG. 11 is an enlarged view of area G in FIG. 10.
Figure 12:
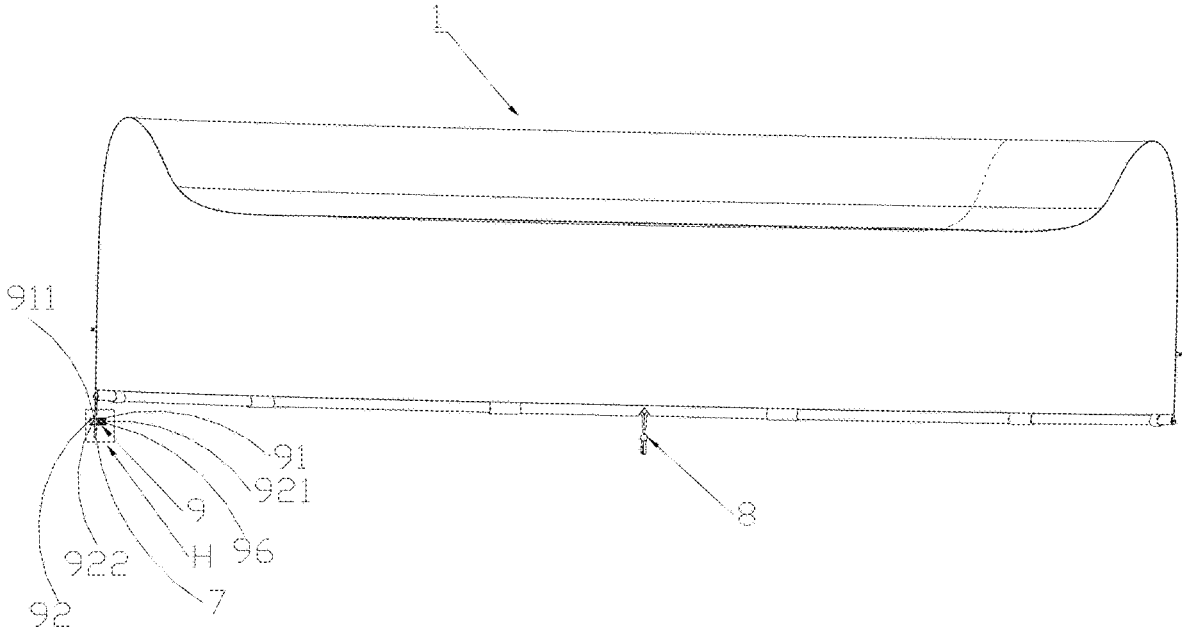
FIG. 12 is a sectional view taken along a third elastic adjusting buckle.
Figure 13:
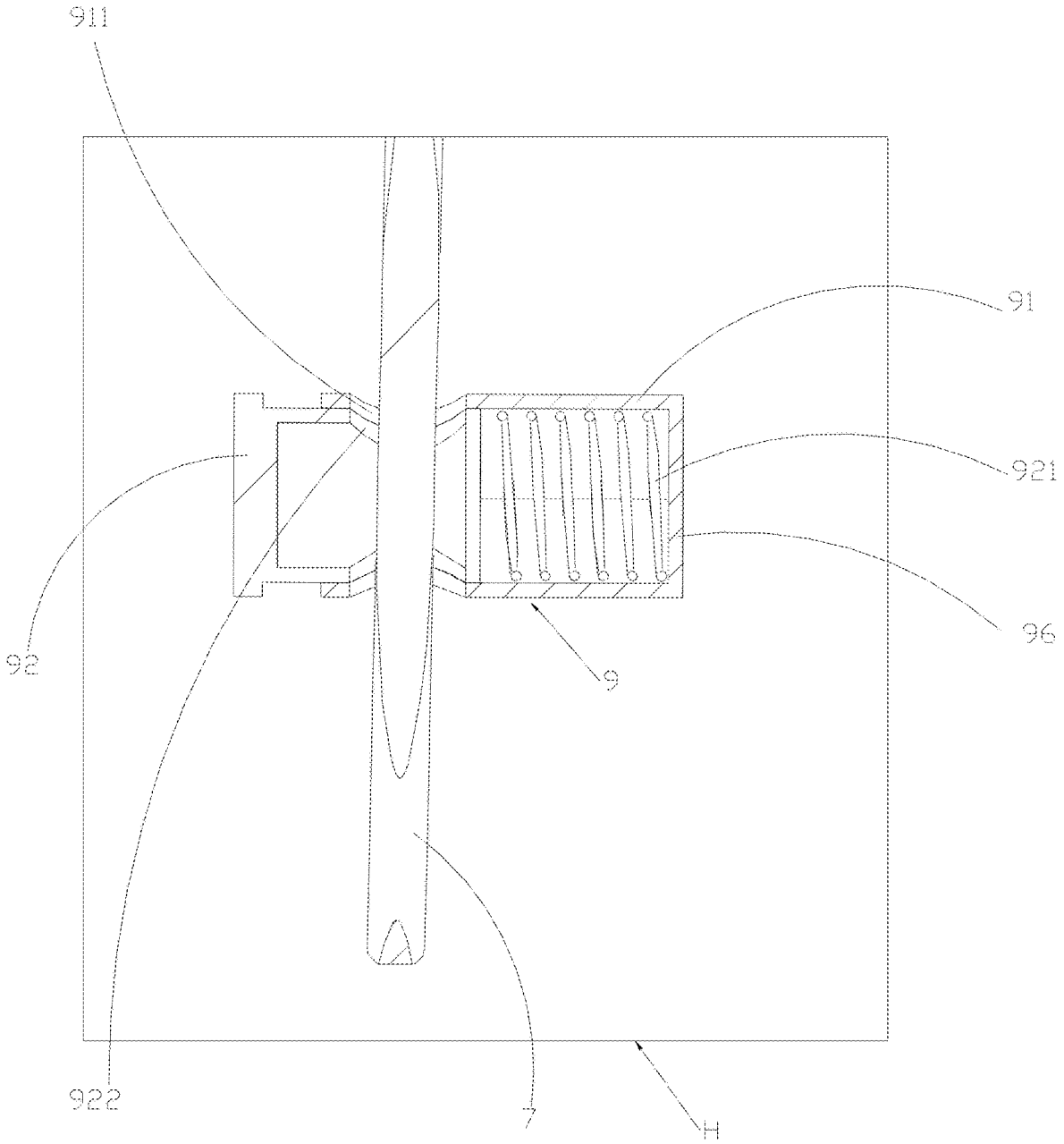
FIG. 13 is an enlarged view of area H in FIG. 12.

Referring to FIGS. 1-13, a swimming pool cover includes:

a flexible cover layer 1, wherein the flexible cover layer 1 includes a middle part 11 and a peripheral part 12, the peripheral part 12 is connected to the middle part 11, the middle part 11 is used for covering a swimming pool opening 21 of a swimming pool 2, the peripheral part 12 is used for surrounding an outer side wall 22 of the swimming pool 2, and the peripheral part 12 is provided with a first outer edge 121;

a hanging lug 3, wherein the hanging lug 3 is connected to the covering layer 1, the hanging lug 3 is positioned on the peripheral part 12, a spacing is defined between the hanging lug 3 and the first outer edge 121, and the hanging lug 3 is provided with a first rope threading opening 31; and a first tightening rope body 4, wherein the first tightening rope body 4 is threaded through the first rope threading opening 31, a spacing is defined between the first tightening rope body 4 and the first outer edge 121, and the first tightening rope body 4 is used for tightening the peripheral part 12 onto the outer side wall 22 of the swimming pool 2.

Through the above structure, the flexible cover layer 1 is configured for completely covering the swimming pool opening 21 of the swimming pool 2, which can effectively prevent dust, fallen leaves, insects, and other debris from entering the swimming pool 2, thereby maintaining the cleanliness of the pool water, reducing cleaning frequency and maintenance costs. Moreover, the peripheral part 12 of the flexible cover layer 1 is used for surrounding the outer side wall 22 of the swimming pool 2, and the stability of the swimming pool cover is increased by a frictional force between the peripheral part 12 and the outer side wall 22 of the swimming pool 2, preventing the swimming pool cover from being displaced. Furthermore, the hanging lug 3 is provided with the first rope threading opening 31, the first tightening rope body 4 is threaded through the first rope threading opening 31, and the first tightening rope body 4 is used for tightening the peripheral part 12 onto the outer side wall 22 of the swimming pool 2, so that the wind resistance of the swimming pool cover is further enhanced, and the swimming pool cover is not easy to be blown up or displaced even in strong wind weather. Furthermore, due to the spacing between the hanging lug 3 and the first outer edge 121, and the spacing between the first tightening rope body 4 and the first outer edge 121, the first outer edge 121 and the first tightening rope body 4 jointly surround and tighten the outer side wall 22 of the swimming pool 2, further enhancing the wind resistance of the swimming pool cover, and making the swimming pool cover not easy to be blown up or displaced even in strong wind weather. Moreover, even when the first tightening rope body 4 is displaced to be detached from the outer side wall 22 of the swimming pool 2, the first outer edge 121 can still surround the outer side wall 22 of the swimming pool 2, preventing the peripheral part 12 from detaching from the outer side wall 22 of the swimming pool 2.

In this embodiment, the swimming pool cover further includes a partition part 5. The partition part 5 divides the first rope threading opening 31 of the hanging lug 3 into a first threading hole 311 and a second threading hole 312. The first tightening rope body 4 is threaded through the first threading hole 311, and the second threading hole 312 is used for connecting with a counterweight 3121 or a ground nail 3122. The partition part 5 is formed by sewing a part of the hanging lug 3 and another part of the hanging lug 3 together using a suture line. Through the above structure, the first tightening rope body 4 is threaded through the first threading hole 311, so that the first tightening rope body 4 tightens the peripheral part 12 onto the outer side wall 22 of the swimming pool 2, further enhancing the wind resistance of the swimming pool cover, and making the swimming pool cover not easy to be blown up or displaced even in strong wind weather. Moreover, by connecting the second threading hole 312 with the counterweight 3121 or the ground nail 3122, the peripheral part 12 of the swimming pool cover is further tightened, thereby preventing the swimming pool cover from being blown up or displaced.

In this embodiment, the swimming pool cover further includes a first adjusting buckle 6. The first tightening rope body 4 is connected to the first adjusting buckle 6. The first tightening rope body 4 is threaded through the first rope threading opening 31 and surrounds to form a first tightening space 41. The first tightening space 41 is used for tightening the peripheral part 12 onto the outer side wall 22 of the swimming pool 2, and the first adjusting buckle 6 is used for adjusting a size of the first tightening space 41. Through the above structure, the first tightening space 41 surrounded and formed by the first tightening rope body 4 can be adjusted to match the outer side wall 22 of the swimming pool 2, so that the peripheral part 12 is tightened onto the outer side wall 22 of the swimming pool 2, and the swimming pool cover is prevented from being blown up or displaced.

In this embodiment, the first adjusting buckle 6 is switchable between a locked state and an unlocked state. When the first adjusting buckle 6 is in the locked state, the first tightening space 41 is contractible, and the first tightening space 41 is not expandable. When the first adjusting buckle 6 is in the unlocked state, the first tightening space 41 is contractible or expandable. The first adjusting buckle 6 is a first ratchet adjusting buckle 66. The first ratchet adjusting buckle 66 includes a first housing 61, a first winding spool 62, and a first pawl 63. The first winding spool 62 is connected to the first housing 61, and the first winding spool 62 is rotatable inside the first housing 61. One end of the first tightening rope body 4 is connected to the first housing 61, and an opposite end of the first tightening rope body 4 is wound around the first winding spool 62 and threaded out of the first housing 61. The first pawl 63 is movable between a locked position and an unlocked position. When the first pawl 63 moves to the locked position, the first pawl 63 engages with a first ratchet 621, the first adjusting buckle 6 is in the locked state, the first winding spool 62 and the first ratchet 621 are rotatable in a first direction to contract the first tightening space 41, the first winding spool 62 and the first ratchet 621 are not rotatable in a second direction to expand the first tightening space 41, and the first direction is opposite to the second direction. The first winding spool 62 extends to form the first ratchet 621. When the first pawl 63 moves to the unlocked position, the first pawl 63 separates from the first ratchet 621, the first adjusting buckle 6 is in the unlocked state, the first winding spool 62 and the first ratchet 621 are rotatable in the first direction to contract the first tightening space 41, and the first winding spool 62 and the first ratchet 621 are rotatable in the second direction to expand the first tightening space 41. Specifically, the first ratchet adjusting buckle 66 also includes a first elastic restoration device 64. The first elastic restoration device 64 is connected to the first housing 61. The first elastic restoration device 64 abuts against the first pawl 63, and the first elastic restoration device 64 pushes the first pawl 63 towards a direction of the first ratchet 621 to the locked position, so that the first pawl 63 engages with the first ratchet 621. Furthermore, the first ratchet 621 is provided with a plurality of interconnected first unidirectional tooth portions 622. The first unidirectional tooth portion 622 includes a first inclined guide surface 6221 and a first stop surface 6222. The first inclined guide surface 6221 is connected to the first stop surface 6222. When the first pawl 63 is engaged with the first ratchet 621, the first ratchet 621 is rotatable in the first direction through the first inclined guide surface 6221 so that the first winding spool 62 is rotatable in the first direction to contract the first tightening space 41, and the first stop surface 6222 blocks the first ratchet 621 from rotating in the second direction so that the first winding spool 62 is not rotatable in the second direction to expand the first tightening space 41. Through the above structure, the arrangement of the first adjusting buckle 6 is effectively achieved. When the first tightening space 41 needs to be contracted, the first ratchet 621 is rotatable in the first direction through the first inclined guide surface 6221, so that the user can move the first tightening rope body 4 in the first direction for contraction. After the contraction is completed, the first stop surface 6222 blocks the first ratchet 621 from rotating in the second direction to prevent the first tightening rope body 4 from moving in the second direction and expanding the first tightening space 41, thereby allowing the first tightening rope body 4 to tighten the peripheral part 12 onto the outer side wall 22 of the swimming pool 2. When it is necessary to expand the first tightening space 41, an external force greater than an elastic restoration force provided by the first elastic restoration device 64 can be applied to the first pawl 63, so that the first pawl 63 is separated from the first ratchet 621, and the first winding spool 62 and the first ratchet 621 are rotatable in the second direction to allow the first tightening rope body 4 to move in the second direction to expand the first tightening space 41. The first elastic restoration device 64 is a first restoration spring. The first winding spool includes a first position limiting plate 623, a second position limiting plate 624, and a first rotating shaft 625. The first rotating shaft 625 is connected to the first position limiting plate and the second position limiting plate. The first rotating shaft is rotatably connected to the first housing. A first position limiting slot is defined between the first position limiting plate and the second position limiting plate. An inner surface of the first position limiting plate and an inner surface of the second position limiting plate are both provided with first locking protrusions 6231. The first locking protrusions lock the first tightening rope body in the first position limiting slot, preventing the first tightening rope body from moving relative to the first position limiting plate and the second position limiting plate.

In this embodiment, the first outer edge 121 is provided with a second rope threading opening 1211. The swimming pool cover further includes a second tightening rope body 7. The second tightening rope body 7 is threaded through the second rope threading opening 1211. The second tightening rope body 7 is used for tightening the first outer edge 121 onto the outer side wall 22 of the swimming pool 2. Through the above structure, the second tightening rope body 7 positioned at the first outer edge 121 and the first tightening rope body 4 positioned at the hanging lug 3 jointly surround and tighten the outer side wall 22 of the swimming pool 2, achieving dual tightening of the peripheral part 12, further enhancing the wind resistance of the swimming pool cover, and making the swimming pool cover not easy to be blown up or displaced even in strong wind weather. Moreover, even when the first tightening rope body 4 is displaced to be detached from the outer side wall 22 of the swimming pool 2, the second tightening rope body 7 positioned at the first outer edge 121 can still surround the outer side wall 22 of the swimming pool 2, preventing the peripheral part 12 from detaching from the outer side wall 22 of the swimming pool 2.

In this embodiment, the swimming pool cover further includes a second adjusting buckle 8. The second tightening rope body 7 is connected to the second adjusting buckle 8. The second tightening rope body 7 is threaded through the second rope threading opening 1211 and surrounds to form a second tightening space 71. The second tightening space 71 is used for tightening the first outer edge 121 onto the outer side wall 22 of the swimming pool 2. The second adjusting buckle 8 is used for adjusting a size of the second tightening space 71. Through the above structure, the second tightening space 71 surrounded and formed by the second tightening rope body 7 can be adjusted to match the outer side wall 22 of the swimming pool 2, so as to tighten the peripheral part 12 onto the outer side wall 22 of the swimming pool 2 and prevent the swimming pool cover from being blown up or displaced.

In this embodiment, the second adjusting buckle 8 is a second ratchet adjusting buckle 86. The second ratchet adjusting buckle 86 includes a second housing 81, a second winding spool 82, and a second pawl 83. The second winding spool 82 is connected to the second housing 81, and the second winding spool 82 is rotatable inside the second housing 81. One end of the second tightening rope body 7 is connected to the second housing 81, and an opposite end of the second tightening rope body 7 is wound around the second winding spool 82 and threaded out of the second housing 81. The second winding spool 82 extends to form a second ratchet 821. The second pawl 83 is movable between a locked position and an unlocked position. When the second pawl 83 moves to the locked position, the second pawl 83 engages with the second ratchet 821, the second adjusting buckle 8 is in a locked state, the second winding spool 82 and the second ratchet 821 are rotatable in a third direction to contract the second tightening space 71, and the second winding spool 82 and the second ratchet 821 are not rotatable in a fourth direction to expand the second tightening space 71, and the third direction is opposite to the fourth direction. When the second pawl 83 moves to the unlocked position, the second pawl 83 separates from the second ratchet 821, the second adjusting buckle 8 is in an unlocked state, the second winding spool 82 and the second ratchet 821 are rotatable in the third direction to contract the second tightening space 71, and the second winding spool 82 and the second ratchet 821 are rotatable in the fourth direction to expand the second tightening space 71. The second ratchet adjusting buckle 86 also includes a second elastic restoration device 84. The second elastic restoration device 84 is connected to the second housing 81. The second elastic restoration device 84 abuts against the second pawl 83, and the second elastic restoration device 84 pushes the second pawl 83 towards a direction of the second ratchet 821 to the locked position, so that the second pawl 83 is engaged with the second ratchet 821. Specifically, the second ratchet 821 is provided with a plurality of interconnected second unidirectional tooth portions 822. The second unidirectional tooth portion 822 includes a second inclined guide surface 8221 and a second stop surface 8222. The second inclined guide surface 8221 is connected to the second stop surface 8222. When the second pawl 83 is engaged with the second ratchet 821, the second ratchet 821 is rotatable in the third direction through the second inclined guide surface 8221 so that the second winding spool 82 is rotatable in the third direction to contract the second tightening space 71, and the second stop surface 8222 blocks the second ratchet 821 from rotating in the fourth direction so that the second winding spool 82 is not rotatable in the fourth direction to expand the second tightening space 71. Through the above structure, the arrangement of the second adjusting buckle 8 is effectively achieved. When the second tightening space 71 needs to be contracted, the second ratchet 821 is rotatable in the third direction through the second inclined guide surface 8221, so that the user can move the second tightening rope body 7 in the third direction for contraction. After the contraction is completed, the second stop surface 8222 blocks the second ratchet 821 from rotating in the fourth direction to prevent the second tightening rope body 7 from moving in the fourth direction and expanding the second tightening space 71, thereby allowing the second tightening rope body 7 to tighten the peripheral part 12 onto the outer side wall 22 of the swimming pool 2. When it is necessary to expand the second tightening space 71, an external force greater than an elastic restoration force provided by the second elastic restoration device 84 can be applied to the second pawl 83, so that the second pawl 83 is separated from the second ratchet 821, and the second winding spool 82 and the second ratchet 821 are rotatable in the fourth direction to allow the second tightening rope body 7 to move in the fourth direction to expand the second tightening space 71. The second elastic restoration device 84 is a second restoration spring. The second winding spool includes a third position limiting plate 823, a fourth position limiting plate 824, and a second rotating shaft 825. The second rotating shaft 825 is connected to the third position limiting plate and the fourth position limiting plate. The second rotating shaft is rotatably connected to the second housing. A second position limiting slot is provided between the third position limiting plate and the fourth position limiting plate. An inner surface of the third position limiting plate and an inner surface of the fourth position limiting plate are both provided with second locking protrusions 8231. The second locking protrusions lock the second tightening rope body in the second position limiting slot, preventing the second tightening rope body from moving relative to the third position limiting plate and the fourth position limiting plate.

In other embodiments, the second adjusting buckle 8 is a second elastic adjusting buckle 85. The second elastic adjusting buckle 85 includes a first adjusting housing 851 and a first elastic column 852. The first elastic column 852 is connected to the first adjusting housing 851, and the first elastic column 852 is slidable inside the first adjusting housing 851 to a locked position or an unlocked position. A first opening 8511 is defined in the first adjusting housing 851. The first elastic column 852 is provided with a first spring 8521 and a second opening 8522. The second tightening rope body 7 passes through the first opening 8511 and the second opening 8522 in sequence, the first spring 8521 pushes the first elastic column 852 towards the locked position, and the first opening 8511 and the second opening 8522 are staggered from each other, so that an inner wall of the first opening 8511 and an inner wall of the second opening 8522 squeeze and lock the second tightening rope body 7, and the second tightening rope body 7 is not movable within the first opening 8511 and the second opening 8522, thereby fixing the size of the second tightening space 71. When the first elastic column 852 is pushed to the unlocked position under an external force, the first opening 8511 and the second opening 8522 are aligned with each other, and the second tightening rope body 7 is movable within the first opening 8511 and the second opening 8522, thereby adjusting the size of the second tightening space 71. Through the above structure, when it is necessary to adjust the second tightening space 71, the first elastic column 852 can be pushed towards the unlocked position, so that the first opening 8511 and the second opening 8522 are aligned with each other, and the second tightening rope body 7 is movable within the first opening 8511 and the second opening 8522, thereby adjusting the size of the second tightening space 71. After adjustment, the first spring 8521 pushes the first elastic column 852 towards the locked position, and the first opening 8511 and the second opening 8522 are staggered from each other, so that the inner wall of the first opening 8511 and the inner wall of the second opening 8522 squeeze and lock the second tightening rope body 7, and the second tightening rope body 7 is not movable within the first opening 8511 and the second opening 8522, thereby fixing the size of the second tightening space 71.

In this embodiment, the swimming pool cover further includes third adjusting buckles 9. The third adjusting buckle 9 is connected to the second tightening rope body 7. The third adjusting buckle 9 is used for adjusting the size of the second tightening space 71. The third adjusting buckle 9 and the second adjusting buckle 8 are different types of adjusting buckles. The third adjusting buckle 9 is a third elastic adjusting buckle 96. The third elastic adjusting buckle 96 includes a second adjusting housing 91 and a second elastic column 92. The second elastic column 92 is connected to the second adjusting housing 91, and the second elastic column 92 is slidable inside the second adjusting housing 91 to a locked position or an unlocked position. A third opening 911 is defined in the second adjusting housing 91. The second elastic column 92 is provided with a second spring 921 and a fourth opening 922. The second tightening rope body 7 passes through the third opening 911 and the fourth opening 922 in sequence, the second spring 921 pushes the second elastic column 92 towards the locked position, and the third opening 911 and the fourth opening 922 are staggered from each other, so that an inner wall of the third opening 911 and an inner wall of the fourth opening 922 squeeze and lock the second tightening rope body 7, and the second fastening rope body 7 is not movable within the third opening 911 and the fourth opening 922, thereby fixing the size of the second tightening space 71. When the second elastic column 92 is pushed to the unlocked position under an external force, the third opening 911 and the fourth opening 922 are aligned with each other, and the second tightening rope body 7 is movable within the third opening 911 and the fourth opening 922, thereby adjusting the size of the second tightening space 71. Through the above structure, when it is necessary to adjust the second tightening space 71, the second elastic column 92 can be pushed towards the unlocked position, so that the third opening 911 and the fourth opening 922 are aligned with each other, and the second tightening rope body 7 is movable within the third opening 911 and the fourth opening 922, thereby adjusting the size of the second tightening space 71. After adjustment, the second spring 921 pushes the second elastic column 92 towards the locked position, and the third opening 911 and the fourth opening 922 are staggered from each other, so that the inner wall of the third opening 911 and the inner wall of the fourth opening 922 squeeze and lock the second tightening rope body 7, and the second tightening rope body 7 is not movable inside the third opening 911 and the fourth opening 922, thereby fixing the size of the second tightening space 71.

In this embodiment, a total number of the third adjusting buckles 9 is multiple, and the plurality of third adjusting buckles 9 are arranged in sequence around the second tightening rope body 7. Through the above structure, the plurality of third adjusting buckles 9 are arranged in sequence around the second tightening rope body 7, which can tighten the second tightening rope body 7 from various positions to more quickly and evenly fasten the first outer edge 121 of the peripheral part 12 onto the outer side wall 22 of the swimming pool 2.

In this embodiment, a width of the second threading hole 312 is greater than a width of the first threading hole 311. A width of the first adjusting buckle 6 is greater than the width of the first threading hole 311. Specifically, the width of the first threading hole 311 and the width of the second threading hole 312 are in a range from 0.1 mm to 20 cm. A width of the cover layer 1 is in a range from 6 feet to 36 feet. A thickness of the cover layer 1 is in a range from 0.1 mm to 10 mm. A width of the partition part 5 is in a range from 1 mm to 5 mm. Through the above structure, the size is set reasonably, so that the swimming pool cover can be adapted to swimming pools 2 of different sizes. Moreover, since the width of the first adjusting buckle 6 is greater than the width of the first threading hole 311, the first adjusting buckle 6 can be prevented from passing through the first threading hole 311, thereby preventing a position of the first adjusting buckle 6 from changing. Specifically, a total number of the hanging lugs 3 is multiple, the plurality of hanging lugs 3 are arranged in sequence around the peripheral part 12.

In this embodiment, the cover layer 1 is formed by stitching a plurality of cover body units through suture lines. The cover layer 1 is an oxford cloth cover layer 1 or a PE woven cloth cover layer. The first tightening rope body 4 is a flexible first tightening rope body 4. Through the above structure, the arrangement of the cover layer 1 and the first tightening rope body 4 has been effectively achieved. Moreover, since the cover layer 1 is formed by stitching the plurality of cover body units 111 through the suture lines, various sizes of swimming pool covers can be formed by stitching, and the utilization rate of materials can be improved, thereby reducing production costs. Moreover, the oxford cloth cover layer 1 or the PE woven cloth cover layer has a long service life and good dust prevention effect, greatly improving the user experience.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A swimming pool cover, comprising:

a flexible cover layer, wherein the flexible cover layer comprises a middle part and a peripheral part, the peripheral part is connected to the middle part, the middle part is used for covering a swimming pool opening of a swimming pool, the peripheral part is used for surrounding an outer side wall of the swimming pool, and the peripheral part is provided with a first outer edge;

a hanging lug, wherein the hanging lug is connected to the flexible cover layer, the hanging lug is positioned on the peripheral part and completely arranged on a radially outside surface of the peripheral part, and the hanging lug is connected to the peripheral part via a connecting piece inserted between the hanging lug and the radially outside surface of the peripheral part, a spacing is defined between the hanging lug and the first outer edge, and the hanging lug is provided with a first rope threading opening; and a first tightening rope body, wherein the first tightening rope body is threaded through the first rope threading opening, a spacing is defined between the first tightening rope body and the first outer edge, and the first tightening rope body is used for tightening the peripheral part onto the outer side wall of the swimming pool.

2. A swimming pool cover, comprising:

a flexible cover layer, wherein the flexible cover layer comprises a middle part and a peripheral part, the peripheral part is connected to the middle part, the middle part is used for covering a swimming pool opening of a swimming pool, the peripheral part is used for surrounding an outer side wall of the swimming pool, and the peripheral part is provided with a first outer edge;

a hanging lug, wherein the hanging lug is connected to the covering layer, the hanging lug is positioned on the peripheral part and completely arranged on a radially outside surface of the peripheral part, a spacing is defined between the hanging lug and the first outer edge, and the hanging lug is provided with a first rope threading opening; and a first tightening rope body, wherein the first tightening rope body is threaded through the first rope threading opening, a spacing is defined between the first tightening rope body and the first outer edge, and the first tightening rope body is used for tightening the peripheral part onto the outer side wall of the swimming pool; and a partition part, wherein the partition part is formed by sewing two parts of the hanging lug together divides the first rope threading opening of the hanging lug into a first threading hole formed between first non-sewn regions of the two parts of the hanging lug and a second threading hole formed between second non-sewn regions of the two parts of the hanging lug, the first tightening rope body is threaded through the first threading hole, and the second threading hole is used for connecting with a counterweight or a ground nail.

3. The swimming pool cover according to claim 1, further comprising a first adjusting buckle, wherein the first tightening rope body is connected to the first adjusting buckle, the first tightening rope body is threaded through the first rope threading opening and surrounds to form a first tightening space, the first tightening space is used for tightening the peripheral part onto the outer side wall of the swimming pool, and the first adjusting buckle is used for adjusting a size of the first tightening space.

4. The swimming pool cover according to claim 3, wherein the first adjusting buckle is switchable between a locked state and an unlocked state; when the first adjusting buckle is in the locked state, the first tightening space is contractible, and the first tightening space is not expandable; and when the first adjusting buckle is in the unlocked state, the first tightening space is contractible or expandable.

5. The swimming pool cover according to claim 4, wherein the first adjusting buckle is a first ratchet adjusting buckle; the first ratchet adjusting buckle comprises a first housing, a first winding spool, and a first pawl; the first winding spool is connected to the first housing, and the first winding spool is rotatable inside the first housing; one end of the first tightening rope body is connected to the first housing, and an opposite end of the first tightening rope body is wound around the first winding spool and threaded out of the first housing; the first winding spool extends to form a first ratchet, and the first pawl is movable between a locked position and an unlocked position; when the first pawl moves to the locked position, the first pawl engages with the first ratchet, the first adjusting buckle is in the locked state, the first winding spool and the first ratchet are rotatable in a first direction to contract the first tightening space, the first winding spool and the first ratchet are not rotatable in a second direction to expand the first tightening space, and the first direction is opposite to the second direction; when the first pawl moves to the unlocked position, the first pawl separates from the first ratchet, the first adjusting buckle is in the unlocked state, the first winding spool and the first ratchet are rotatable in the first direction to contract the first tightening space, and the first winding spool and the first ratchet are rotatable in the second direction to expand the first tightening space.

6. The swimming pool cover according to claim 5, wherein the first ratchet adjusting buckle also comprises a first elastic restoration device, the first elastic restoration device is connected to the first housing, the first elastic restoration device abuts against the first pawl, and the first elastic restoration device pushes the first pawl towards a direction of the first ratchet to the locked position, so that the first pawl engages with the first ratchet.

7. The swimming pool cover according to claim 6, wherein the first ratchet is provided with a plurality of interconnected first unidirectional tooth portions, the first unidirectional tooth portion comprises a first inclined guide surface and a first stop surface, and the first inclined guide surface is connected to the first stop surface; when the first pawl is engaged with the first ratchet, the first ratchet is rotatable in the first direction through the first inclined guide surface so that the first winding spool is rotatable in the first direction to contract the first tightening space, and the first stop surface blocks the first ratchet from rotating in the second direction so that the first winding spool is not rotatable in the second direction to expand the first tightening space.

8. A swimming pool cover, comprising:

a flexible cover layer, wherein the flexible cover layer comprises a middle part and a peripheral part, the peripheral part is connected to the middle part, the middle part is used for covering a swimming pool opening of a swimming pool, the peripheral part is used for surrounding an outer side wall of the swimming pool, and the peripheral part is provided with a first outer edge configured to extend downwards for connecting with a counterweight or a ground nail;

a hanging lug, wherein the hanging lug is connected to the covering layer, the hanging lug is positioned on the peripheral part and completely arranged on a radially outside surface of the peripheral part, a spacing is defined between the hanging lug and the first outer edge, and the hanging lug is provided with a first rope threading opening; and a first tightening rope body, wherein the first tightening rope body is threaded through the first rope threading opening, a spacing is defined between the first tightening rope body and the first outer edge, and the first tightening rope body is used for tightening the peripheral part onto the outer side wall of the swimming pool; and wherein the first outer edge is provided with a second rope threading opening, the swimming pool cover further comprises a second tightening rope body, the second tightening rope body is threaded through the second rope threading opening, and the second tightening rope body is used for tightening a bottom edge of the first outer edge onto the outer side wall of the swimming pool.

9. The swimming pool cover according to claim 8, further comprising a second adjusting buckle, wherein the second tightening rope body is connected to the second adjusting buckle, the second tightening rope body is threaded through the second rope threading opening and surrounds to form a second tightening space, the second tightening space is used for tightening the first outer edge onto the outer side wall of the swimming pool, and the second adjusting buckle is used for adjusting a size of the second tightening space.

10. The swimming pool cover according to claim 9, wherein the second adjusting buckle is a second ratchet adjusting buckle; the second ratchet adjusting buckle comprises a second housing, a second winding spool, and a second pawl; the second winding spool is connected to the second housing, and the second winding spool is rotatable inside the second housing; one end of the second tightening rope body is connected to the second housing, and an opposite end of the second tightening rope body is wound around the second winding spool and threaded out of the second housing; the second winding spool extends to form a second ratchet, and the second pawl is movable between a locked position and an unlocked position; when the second pawl moves to the locked position, the second pawl engages with the second ratchet, the second adjusting buckle is in a locked state, the second winding spool and the second ratchet are rotatable in a third direction to contract the second tightening space, the second winding spool and the second ratchet are not rotatable in a fourth direction to expand the second tightening space, and the third direction is opposite to the fourth direction; when the second pawl moves to the unlocked position, the second pawl separates from the second ratchet, the second adjusting buckle is in an unlocked state, the second winding spool and the second ratchet are rotatable in the third direction to contract the second tightening space, and the second winding spool and the second ratchet are rotatable in the fourth direction to expand the second tightening space.

11. The swimming pool cover according to claim 10, wherein the second ratchet adjusting buckle also comprises a second elastic restoration device, the second elastic restoration device is connected to the second housing, the second elastic restoration device abuts against the second pawl, and the second elastic restoration device pushes the second pawl towards a direction of the second ratchet to the locked position, so that the second pawl is engaged with the second ratchet.

12. The swimming pool cover according to claim 11, wherein the second ratchet is provided with a plurality of interconnected second unidirectional tooth portions, the second unidirectional tooth portion comprises a second inclined guide surface and a second stop surface, and the second inclined guide surface is connected to the second stop surface; when the second pawl is engaged with the second ratchet, the second ratchet is rotatable in the third direction through the second inclined guide surface so that the second winding spool is rotatable in the third direction to contract the second tightening space, and the second stop surface blocks the second ratchet from rotating in the fourth direction so that the second winding spool is not rotatable in the fourth direction to expand the second tightening space.

13. The swimming pool cover according to claim 9, wherein the second adjusting buckle is a second elastic adjusting buckle, the second elastic adjusting buckle comprises a first adjusting housing and a first elastic column, the first elastic column is connected to the first adjusting housing, and the first elastic column is slidable inside the first adjusting housing to a locked position or an unlocked position; a first opening is defined in the first adjusting housing, the first elastic column is provided with a first spring and a second opening, the second tightening rope body passes through the first opening and the second opening in sequence, the first spring pushes the first elastic column towards the locked position, and the first opening and the second opening are staggered from each other, so that an inner wall of the first opening and an inner wall of the second opening squeeze and lock the second tightening rope body, and the second tightening rope body is not movable within the first opening and the second opening, thereby fixing the size of the second tightening space; when the first elastic column is pushed to the unlocked position under an external force, the first opening and the second opening are aligned with each other, and the second tightening rope body is movable within the first opening and the second opening, thereby adjusting the size of the second tightening space.

14. The swimming pool cover according to claim 9, further comprising a third adjusting buckle, wherein the third adjusting buckle is connected to the second tightening rope body, the third adjusting buckle is used for adjusting the size of the second tightening space, and the third adjusting buckle and the second adjusting buckle are different types of adjusting buckles.

15. The swimming pool cover according to claim 14, wherein the third adjusting buckle is a third elastic adjusting buckle, the third elastic adjusting buckle comprises a second adjusting housing and a second elastic column, the second elastic column is connected to the second adjusting housing, the second elastic column is slidable inside the second adjusting housing to a locked position or an unlocked position, a third opening is defined in the second adjusting housing, the second elastic column is provided with a second spring and a fourth opening, the second tightening rope body passes through the third opening and the fourth opening in sequence, the second spring pushes the second elastic column towards the locked position, and the third opening and the fourth opening are staggered from each other, so that an inner wall of the third opening and an inner wall of the fourth opening squeeze and lock the second tightening rope body, and the second fastening rope body is not movable within the third opening and the fourth opening, thereby fixing the size of the second tightening space; when the second elastic column is pushed to the unlocked position under an external force, the third opening and the fourth opening are aligned with each other, and the second tightening rope body is movable within the third opening and the fourth opening, thereby adjusting the size of the second tightening space.

16. The swimming pool cover according to claim 14, wherein a total number of the third adjusting buckle is multiple, and the multiple third adjusting buckles are arranged in sequence around the second tightening rope body.

17. The swimming pool cover according to claim 2, wherein a width of the second threading hole is greater than a width of the first threading hole.

18. The swimming pool cover according to claim 3, further comprising a partition part, wherein the partition part divides the first rope threading opening of the hanging lug into a first threading hole and a second threading hole, the first tightening rope body is threaded through the first threading hole, the second threading hole is used for connecting with a counterweight or a ground nail, and a width of the first adjusting buckle is greater than a width of the first threading hole.

19. The swimming pool cover according to claim 2, wherein a width of the first threading hole and a width of the second threading hole are in a range from 0.1 mm to 20 cm, a width range of the cover layer is in a range from 6 feet to 36 feet, a thickness of the cover layer is in a range from 0.1 mm to 10 mm, and a width of the partition part is in a range from 1 mm to 5 mm.

20. The swimming pool cover according to claim 1, wherein the cover layer is formed by stitching a plurality of cover body units through suture lines, the cover layer is an oxford cloth cover layer or a PE woven cloth cover layer, and the first tightening rope body is a flexible first tightening rope body.

* * * * *